US011121508B2

(12) United States Patent
Kim et al.

(10) Patent No.: US 11,121,508 B2
(45) Date of Patent: Sep. 14, 2021

(54) COAXIAL CABLE MALE CONNECTOR FOR TRANSMITTING SUPER-HIGH FREQUENCY SIGNALS

(71) Applicant: SENSORVIEW INCORPORATED, Gyeonggi-do (KR)

(72) Inventors: Byoung Nam Kim, Gyeonggi-do (KR); Kyoung Il Kang, Gyeonggi-do (KR); Sang Woo Han, Gyeonggi-do (KR); Ji Hun Kang, Gyeonggi-do (KR)

(73) Assignee: SENSORVIEW INCORPORATED, Gyeonggi-do (KR)

( * ) Notice: Subject to any disclaimer, the term of this patent is extended or adjusted under 35 U.S.C. 154(b) by 0 days.

(21) Appl. No.: 16/898,555

(22) Filed: Jun. 11, 2020

(65) Prior Publication Data

US 2020/0395716 A1 Dec. 17, 2020

(30) Foreign Application Priority Data

Jun. 14, 2019 (KR) ..... 10-2019-0071043
Nov. 13, 2019 (KR) ..... 10-2019-0145208

(51) Int. Cl.
*H01R 13/6593* (2011.01)
*H01R 12/75* (2011.01)
(Continued)

(52) U.S. Cl.
CPC ..... *H01R 13/6593* (2013.01); *H01R 12/75* (2013.01); *H01R 9/0515* (2013.01);
(Continued)

(58) Field of Classification Search
CPC .... H01R 13/6593; H01R 12/75; H01R 24/50; H01R 13/6591; H01R 13/6594;
(Continued)

(56) References Cited

U.S. PATENT DOCUMENTS

2005/0095902 A1 5/2005 Zhang et al.
2006/0228952 A1* 10/2006 Feldman ..... H01R 12/79 439/835
(Continued)

FOREIGN PATENT DOCUMENTS

WO WO-2008/123652 A1 10/2008

OTHER PUBLICATIONS

Extended European Search Report from corresponding European Patent Application No. 20179706.5, dated Nov. 10, 2020.

*Primary Examiner* — Abdullah A Riyami
*Assistant Examiner* — Justin M Kratt
(74) *Attorney, Agent, or Firm* — Harness, Dickey & Pierce, P.L.C.

(57) ABSTRACT

Disclosed is a coaxial cable male connector for transmitting super-high frequency signals, which is used in a coaxial cable connector for transmitting super-high frequency signals and is received in a connector socket mounted on a printed circuit board (PCB) to connect multiple coaxial cables to the PCB. The coaxial cable male connector includes: a single or multiple coaxial cables each including an inner conductor, an outer conductor, a dielectric, and a sheath, wherein the outer conductor, the dielectric, and the sheath are partially stripped to expose the inner conductor over a predetermined length, and a terminal of the exposed inner conductor is brought into electrical connect with a signal line terminal pad formed on the PCB; and a shielding can receiving the exposed inner conductors of the single or multiple coaxial cables, securing and protecting ends of the exposed inner conductors, and blocking electromagnetic waves generated from the inner conductors.

3 Claims, 10 Drawing Sheets

(51) Int. Cl.

| | |
|---|---|
| *H01R 13/6581* | (2011.01) |
| *H01R 12/71* | (2011.01) |
| *H01R 13/6594* | (2011.01) |
| *H01R 13/6591* | (2011.01) |
| *H01R 9/05* | (2006.01) |
| *H01R 12/79* | (2011.01) |
| *H01R 13/627* | (2006.01) |
| *H01R 12/59* | (2011.01) |
| *H01R 13/02* | (2006.01) |
| *H01R 12/77* | (2011.01) |
| *H01R 24/50* | (2011.01) |
| *H01R 13/6582* | (2011.01) |
| *H01R 13/6592* | (2011.01) |
| *H01R 12/70* | (2011.01) |

(52) U.S. Cl.

CPC ..... *H01R 12/598* (2013.01); *H01R 12/7052* (2013.01); *H01R 12/714* (2013.01); *H01R 12/716* (2013.01); *H01R 12/775* (2013.01); *H01R 12/777* (2013.01); *H01R 12/778* (2013.01); *H01R 12/79* (2013.01); *H01R 13/02* (2013.01); *H01R 13/6275* (2013.01); *H01R 13/6581* (2013.01); *H01R 13/6582* (2013.01); *H01R 13/6591* (2013.01); *H01R 13/6592* (2013.01); *H01R 13/6594* (2013.01); *H01R 24/50* (2013.01)

(58) Field of Classification Search

CPC ..... H01R 13/6582; H01R 9/0515; H01R 12/716; H01R 12/777; H01R 12/598; H01R 12/714; H01R 12/775; H01R 12/778; H01R 12/79; H01R 13/02; H01R 13/6581; H01R 13/6592; H01R 13/6275; H01R 12/7052

See application file for complete search history.

(56) References Cited

U.S. PATENT DOCUMENTS

| | | | |
|---|---|---|---|
| 2014/0187087 A1 | 7/2014 | Mason et al. | |
| 2017/0033512 A1* | 2/2017 | Chen | H01R 13/6581 |

* cited by examiner

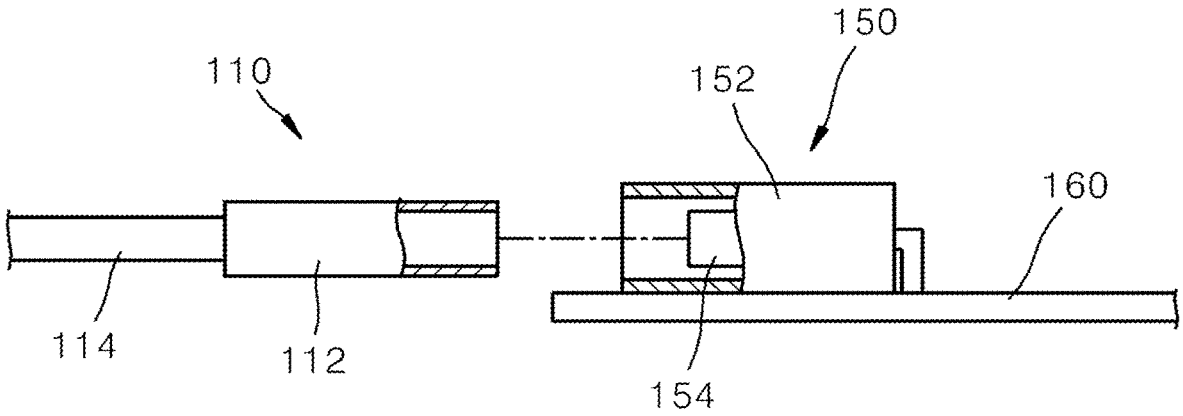
FIG. 1 – Prior Art
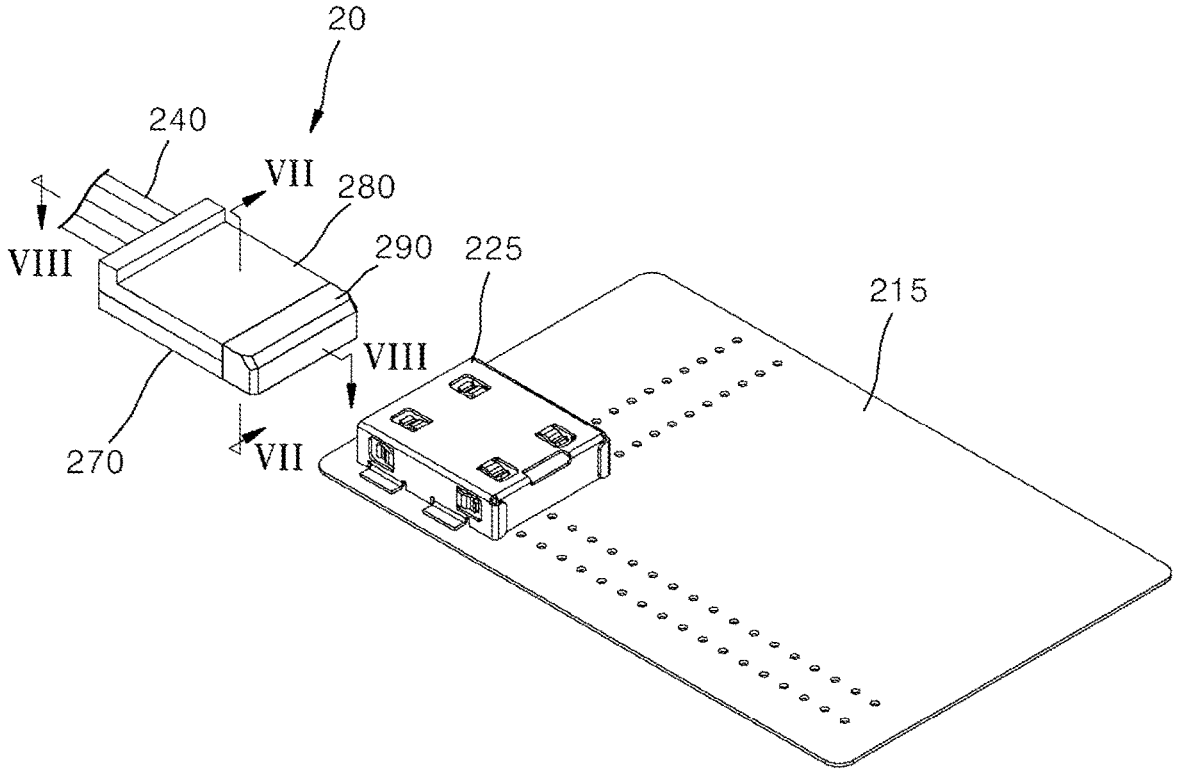
FIG. 2

COAXIAL CABLE MALE CONNECTOR FOR TRANSMITTING SUPER-HIGH FREQUENCY SIGNALS

CROSS-REFERENCE TO RELATED APPLICATIONS

This application claims the benefit of Korean Patent Application Nos. 10-2019-0145208, filed on Nov. 13, 2019 and 10-2019-0071043, filed on Jun. 14, 2019, the entire disclosures of which are incorporated herein by references.

FIELD

The present invention relates to a connector, and, more particularly, to a coaxial cable male connector for transmitting super-high frequency signals, which is a male connector of a PCB multi-connector adapted to directly connect coaxial cable inner conductors, which are signal lines, to circuit signal line pads on a printed circuit board, respectively.

BACKGROUND

FIG. 1 is a sectional view of a typical PCB mono- or multi-connector. In the PCB mono- or multi-connector, a male connector 112 including a male connector housing 112 covering a terminal of an electrical signal line 114 for transmitting electrical signals, such as a cable or a wire, is inserted into and connected to a female connector (or socket) 150 mounted on a PCB 160. Here, a female connector housing 152 of the female connector 150 is provided with a reception member 154 receiving the terminal (or pin) in the male connector. However, such a typical PCB mono- or multi-connector has a problem in that leakage current and noise are likely to occur through the reception member 154, causing signal loss, and there is a limit to miniaturization of the connector.

SUMMARY

Embodiments of the present invention have been conceived to solve such a problem of typical mono- or multi-connectors and it is an aspect of the present invention to provide a coaxial cable male connector for transmitting super-high frequency signals, which is a male connector of a PCB multi-connector including a female connector that includes only a housing socket mounted on a PCB and receiving a male connector housing without a separate terminal reception member for receiving coaxial cable terminals in a male connector, such that the coaxial cable terminals in the male connector can be brought into direct contact with circuit signal line terminal pads on the PCB, respectively, the male connector being adapted to allow coaxial cable inner conductors, that is, a single or multiple super-high frequency signal lines, to be brought into direct contact with the terminal pads on the PCB, respectively, thereby minimizing signal loss and allowing miniaturization through significant reduction in height of the connector.

In accordance with an aspect of the present invention, there is provided a coaxial cable male connector for transmitting super-high frequency signals, which is received in a connector socket mounted on a printed circuit board (PCB) to connect a single or multiple coaxial cables to the PCB, the coaxial cable male connector including: a single or multiple coaxial cables each including an inner conductor, an outer conductor, a dielectric, and a sheath, wherein the outer conductor, the dielectric, and the sheath are partially stripped to expose the inner conductor over a predetermined length, and a terminal of the exposed inner conductor is brought into electrical connect with a signal line terminal pad formed on the PCB; and a shielding can receiving the exposed inner conductors of the single or multiple coaxial cables, securing and protecting ends of the exposed inner conductors, and blocking electromagnetic waves generated from the inner conductors, wherein the terminals of the inner conductors of the coaxial cables are formed on a bottom surface of the shielding can to be brought into direct contact with the signal line terminal pads formed on the PCB, respectively. The shielding can may be connected to the outer conductors of the coaxial cables and may include an inner conductor reception portion receiving the exposed inner conductors of the respective coaxial cables to be coupled to the exposed inner conductors, and the inner conductors coupled to the inner conductor reception portion are electrically shielded when the coaxial cable male connector is seated on the PCB.

The coaxial cable male connector may further include: adapters each connected at one end thereof to corresponding one of the exposed inner conductors of the coaxial cables and connected at the other end thereof to corresponding one of the circuit signal line terminal pads formed on the PCB to allow easy contact between the terminals of the inner conductors of the coaxial cables and the circuit signal line terminal pads formed on the PCB, and the terminals of the inner conductors of the coaxial cables are connected to the circuit signal line terminal pads formed on the PCB via the adapters, respectively. The shielding can may include an adapter reception portion receiving the adapters one-to-one connected to the exposed inner conductors of the coaxial cables, the adapter reception portion being shaped to individually shield the adapters. The shielding can may be connected to the outer conductors of the coaxial cables; and the connector socket may receive the shielding can and may be electrically connected to the shielding can and a ground terminal of the PCB to electrically shield the exposed inner conductors of the coaxial cables and the adapters. The shielding can may include: a lower shielding member forming a lower portion of the shielding can and receiving the exposed inner conductors of the coaxial cables such that the ends of the exposed inner conductors are located thereon; an upper shielding member covering the exposed inner conductors of the coaxial cables received in the lower shielding member; and a front shielding member forming a front portion of the shielding can and coupled to the lower shielding member and the upper shielding member to shield the exposed inner conductors of the coaxial cables. The shielding can may include: a first shielding member forming a lower portion of the shielding can and receiving the exposed inner conductors of the coaxial cables such that the ends of the exposed inner conductors are located thereon; and a second shielding member coupled to the first shielding member to shield the exposed inner conductors of the coaxial cables. The shielding can may be a shielding member having upper, lower, and front portions integrally formed with one another, having a bottom surface on which the ends of the exposed inner conductors of the coaxial cables are located, and adapted to shield the exposed inner conductors of the coaxial cables.

According to the present invention, the coaxial cable male connector for transmitting super high-frequency signals according to the present invention, which corresponds to a male connector of a coaxial cable multi-connector, is inserted into and fastened to a connector socket without a reception member receiving coaxial cable inner conductor terminals such that signal line terminals in the coaxial cable male connector can be bought into direct contact with signal line terminal pads on a PCB, respectively, or adapters are provided to allow easy contact between the signal line terminals in the coaxial cable male connector and the respective signal line terminal pads on the PCB, thereby minimizing leakage current and thus reducing signal loss while allowing minimization of the connector through reduction in fastening height of the connector.

In addition, according to the present invention, outer conductors, which are shielding layers of the coaxial cables connected to the male connector, are connected to a shielding can blocking electromagnetic waves generated from inner conductors, which are signal lines of the coaxial cables, and the connector socket mounted on the PCB and connected to a ground terminal of the PCB is brought into contact with and electrically connected to the shielding can of the coaxial cable male connector by receiving the shielding can, thereby reducing signal loss in the signal line terminals in the coaxial cable male connector, which directly contact the circuit signal terminal pads on the PCB, respectively.

BRIEF DESCRIPTION OF THE DRAWINGS

FIG. 1 is a side sectional view of a typical PCB multi-connector;

FIG. 2 is a view of an example of a coaxial cable connector for transmitting super-high frequency signals to which the present invention is applied, with a coaxial cable male connector for transmitting super-high frequency signals according to the present invention not fastened to a connector socket mounted on a PCB;

DETAILED DESCRIPTION

Hereinafter, embodiments of the present invention will be described with reference to the accompanying drawings. It will be understood that the embodiments and the drawings described in the specification are not exhaustive but solely illustrative and there are present various alterations and equivalent embodiments thereof at the time of filing the present application.

A coaxial cable connector for transmitting super-high frequency signals, to which the present invention is applied, is a printed circuit board (PCB) connector that connects a PCB to multiple coaxial cable inner conductors transmitting electrical signals therethrough, and includes a male connector and a connector socket.

Figure 3:
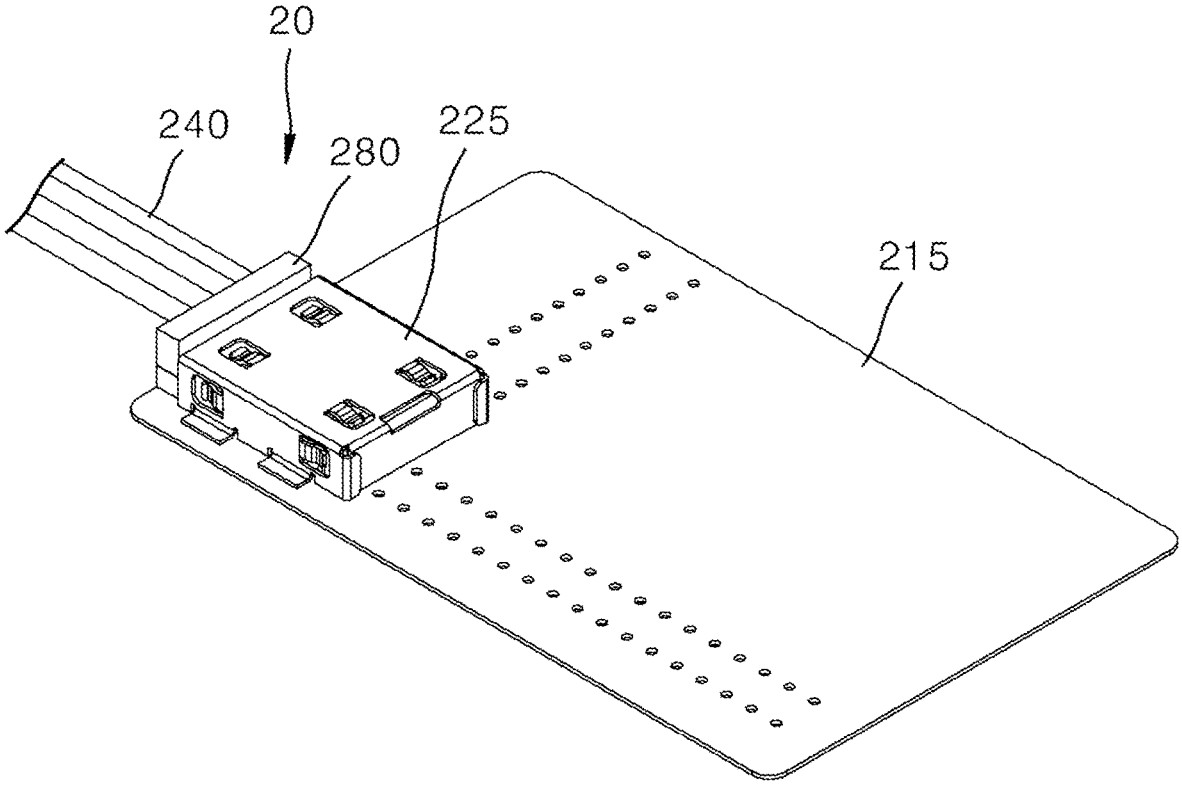
FIG. 3 is a view of the coaxial cable connector for transmitting super-high frequency signals to which the present invention is applied, with the coaxial cable male connector for transmitting super-high frequency signals according to the present invention fastened to the connector socket mounted on the PCB.

FIG. 2 is a view of an example of the coaxial cable connector for transmitting super-high frequency signals, to which the present invention is applied, with a coaxial cable male connector 20 for transmitting super-high frequency signals according to the present invention not fastened to a connector socket 225 mounted on a PCB 215. FIG. 3 is a view of the coaxial cable connector for transmitting super-high frequency signals, to which the present invention is applied, with the coaxial cable male connector 20 for transmitting super-high frequency signals according to the present invention fastened to the connector socket 225 mounted on the PCB 215. Referring to FIG. 2 and FIG. 3, a housing 270, 280, 290 of a coaxial cable multi-connector connected to coaxial cables 240 is inserted into and fastened to the connector socket 225 mounted on the PCB 125. Here, connection between circuit signal line terminal pads on the PCB 215 and inner conductors of the coaxial cables 240 is established by bringing coaxial cable inner conductor terminals formed on a bottom surface of the coaxial cable male connector according to the present invention into contact with the circuit signal line terminal pads formed on the PCB 215, respectively.

Figure 4:
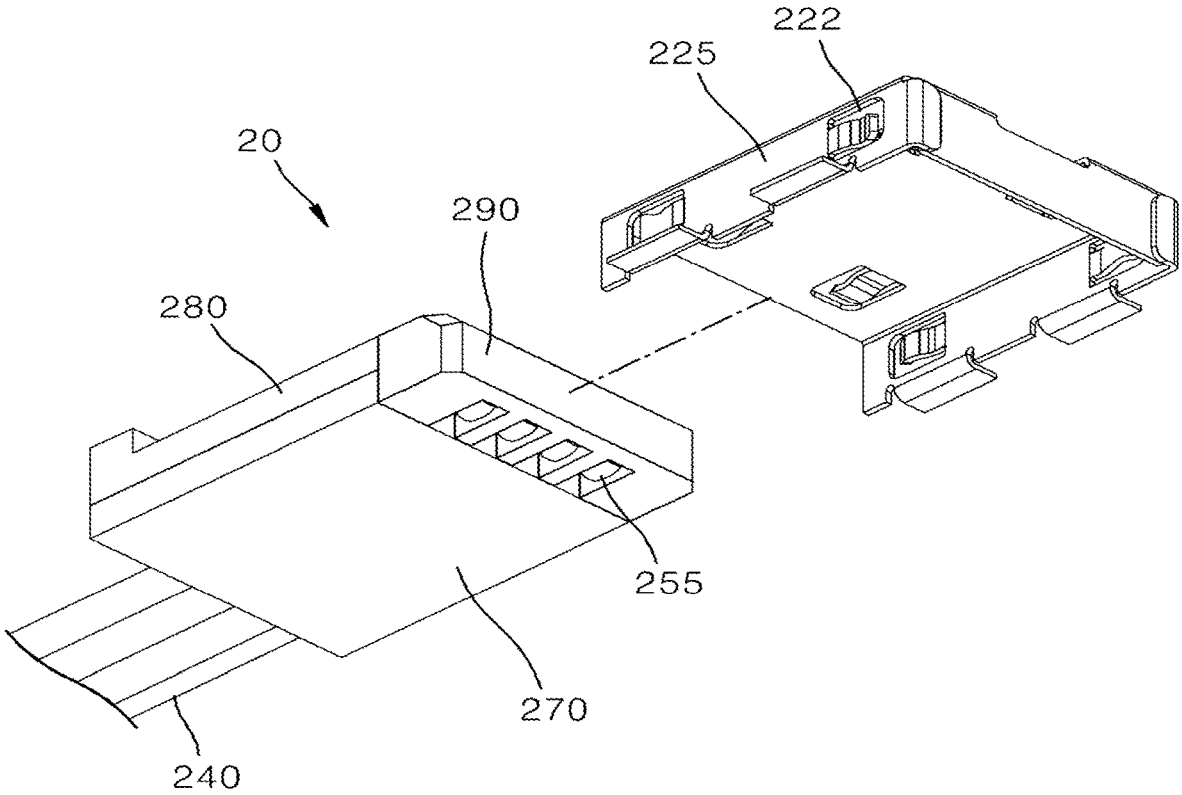
FIG. 4 is a bottom perspective view of the coaxial cable male connector according to the present invention and the connector socket.
Figure 5:
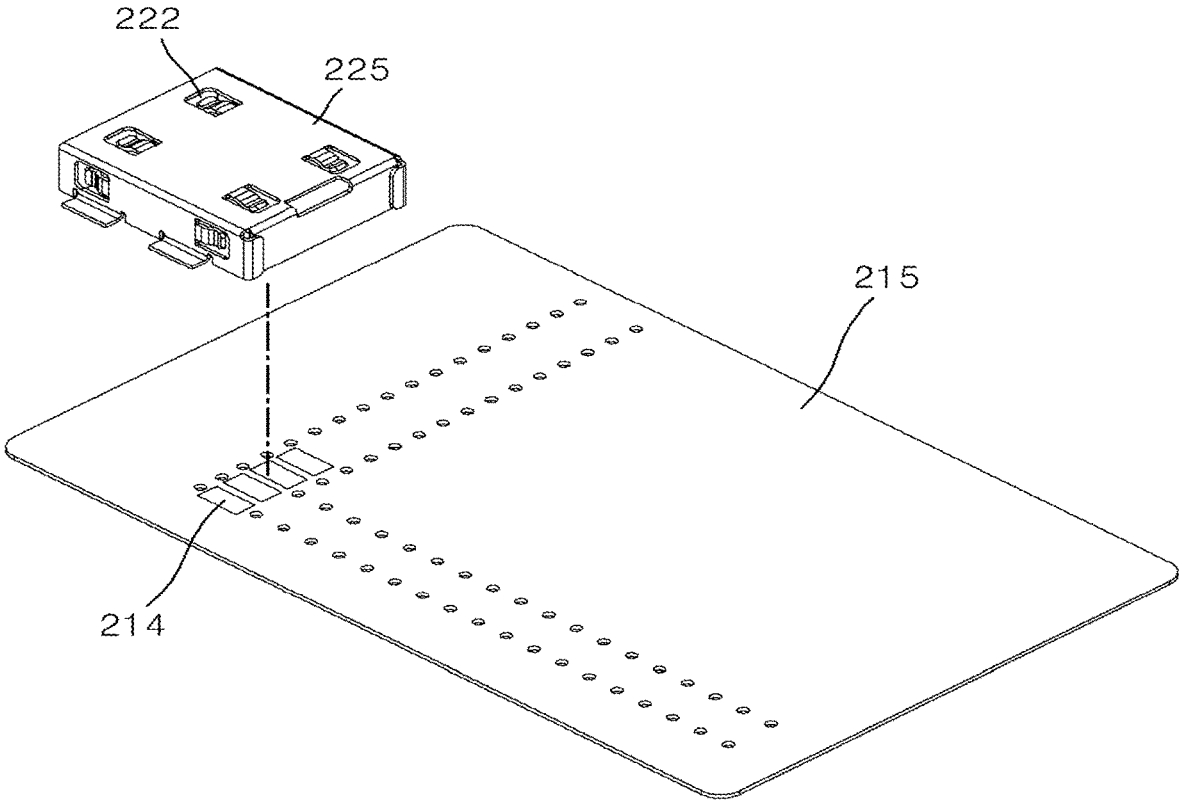
FIG. 5 is an exploded perspective view of an example of the connector socket of the coaxial cable connector for transmitting super-high frequency signals to which the present invention is applied.

FIG. 4 is a bottom perspective view of the coaxial cable male connector 20 for transmitting super-high frequency signals and the connector socket 225 according to the present invention. FIG. 5 is an exploded perspective view of the coaxial cable connector for transmitting super-high frequency signals to which the present invention is applied, showing the connector socket 225 and the PCB 215. Referring to FIG. 4 and FIG. 5, cable signal line terminals 255 are formed on the bottom surface of the male connector 20. The connector socket 225 may include a fastening portion 222 to be fastened to the coaxial cable male connector 20. The connector socket 225 may be mounted on the PCB 215 by surface-mount technology (SMT), through-hole-mount technology, such as single in-line package (SIP) technology, dual in-line package (DIP) technology, and quad in-line package QIP technology, or a combination of surface-mount technology and through-hole-mount technology. Alternatively, the connector socket 225 may be integrally formed with the PCB, rather than formed separately from the PCB.

When the housing 270, 280, 290 of the coaxial cable male connector 20 for transmitting super-high frequency signals is inserted into and fastened to the connector socket 225 mounted on the PCB 125, the cable signal line terminals 255 are brought into direct contact with the circuit signal line terminal pads 214 formed on the PCB 215, respectively, without using a separate reception member receiving the coaxial cable signal line terminals 255. According to the present invention, since the connector socket 225 mounted on the PCB 125 is not provided with such a reception member receiving the cable signal line terminals 255, as shown in FIG. 4, the structure of the connector socket can be simplified and the height at which the connector socket is fastened to the coaxial cable male connector 20 for transmitting super-high frequency signals, which corresponds to a male connector, can be minimized, thereby allowing miniaturization of the connector socket. The coaxial cable connector for transmitting super-high frequency signals, to which the present invention is applied, can connect signal lines for transmitting electrical signals, such as RF signals and power supply signals, to the PCB or a power supply, and can be applied to various electronic devices requiring miniaturization of a related connector, such as tablet PCs, laptop PCs, 5G smartphones, and home appliances (for example, TVs, refrigerators, washing machines, and the like).

Figure 6:
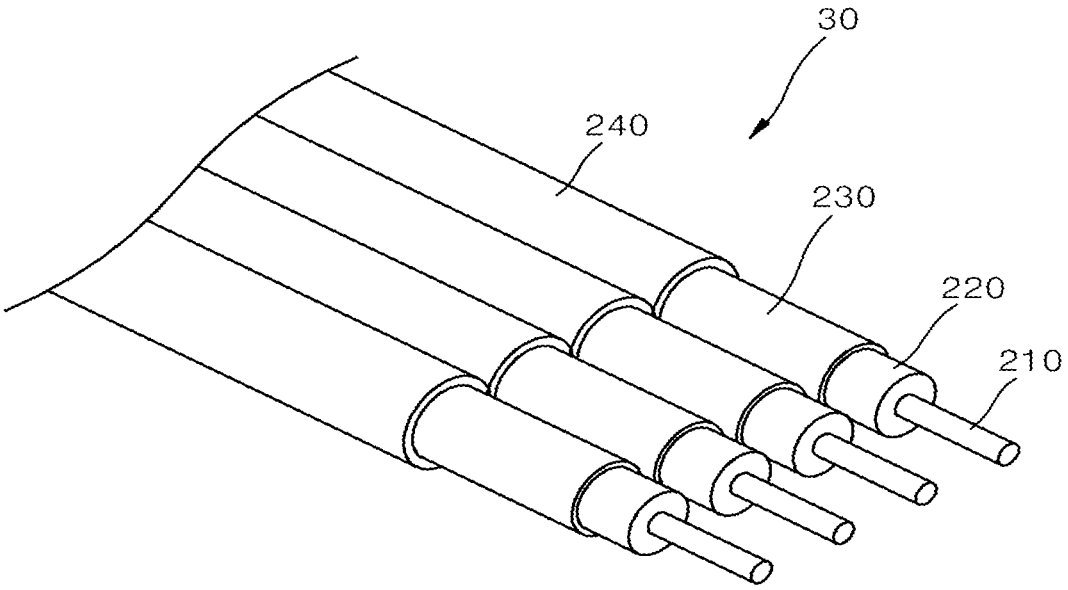
FIG. 6 is a view of an example of a multiple coaxial cables connected to the coaxial cable male connector for transmitting super-high frequency signals according to the present invention.

The coaxial cable male connector for transmitting super-high frequency signals according to the present invention is received in the connector socket mounted on the PCB to connect a multiple coaxial cables to the circuit signal line terminal pads on the PCB, and includes the multiple coaxial cables 240 and a shielding can 270, 280, 290. FIG. 6 is a view of an example of the coaxial cables 30 connected to the coaxial cable male connector 20 for transmitting super-high frequency signals according to the present invention. Each of the multiple coaxial cables includes an inner conductor 210, an outer conductor 230, a dielectric 220, and a sheath 240, wherein the sheath, the outer conductor, and the dielectric are stripped over different lengths to expose the inner conductor over a predetermined length, and a terminal of the exposed inner conductor 210 is brought into direct contact with the signal line terminal pad 214 formed on the PCB 215. That is, as shown in FIG. 4 and FIG. 5, coaxial cable inner conductor terminals 255 to be brought into direct contact with respective signal line terminal pads 314 formed on the PCB 215 are formed on a bottom surface of a lower shielding member 270.

Referring to FIG. 6, each of the coaxial cables 30 includes the inner conductor 210 used as the signal line, the outer conductor 230 formed of aluminum, copper, or the like and blocking electromagnetic waves generated from the inner conductor 210, the dielectric 220 insulating and isolating the inner conductor 210 from the outer conductor 230, and the sheath (or jacket) protecting the outer conductor 230. The internal conductor may transmit various electrical signals, such as DC signals, microwave signals, and millimeter wave signals, particularly, super-high frequency signals of about 50 GHz or more. The connector socket is mounted on the PCB and receives the shielding can, which is the housing of the coaxial cable multi-connector, to be fastened to the coaxial cable male connector for transmitting super-high frequency signals.

Figure 7:
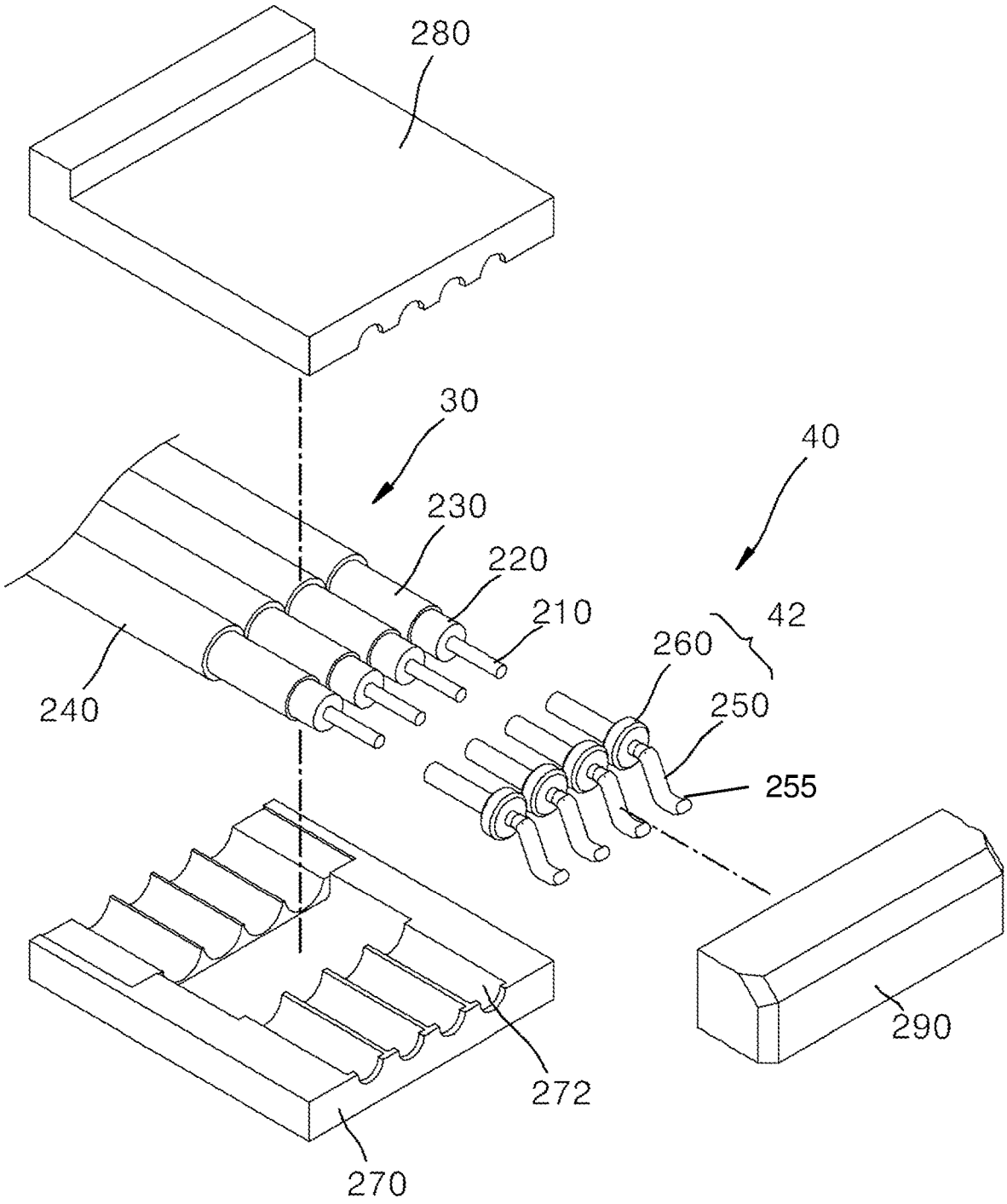
FIG. 7 is a view of exemplary components constituting the coaxial cable male connector for transmitting super-high frequency signals according to the present invention.
Figure 11:
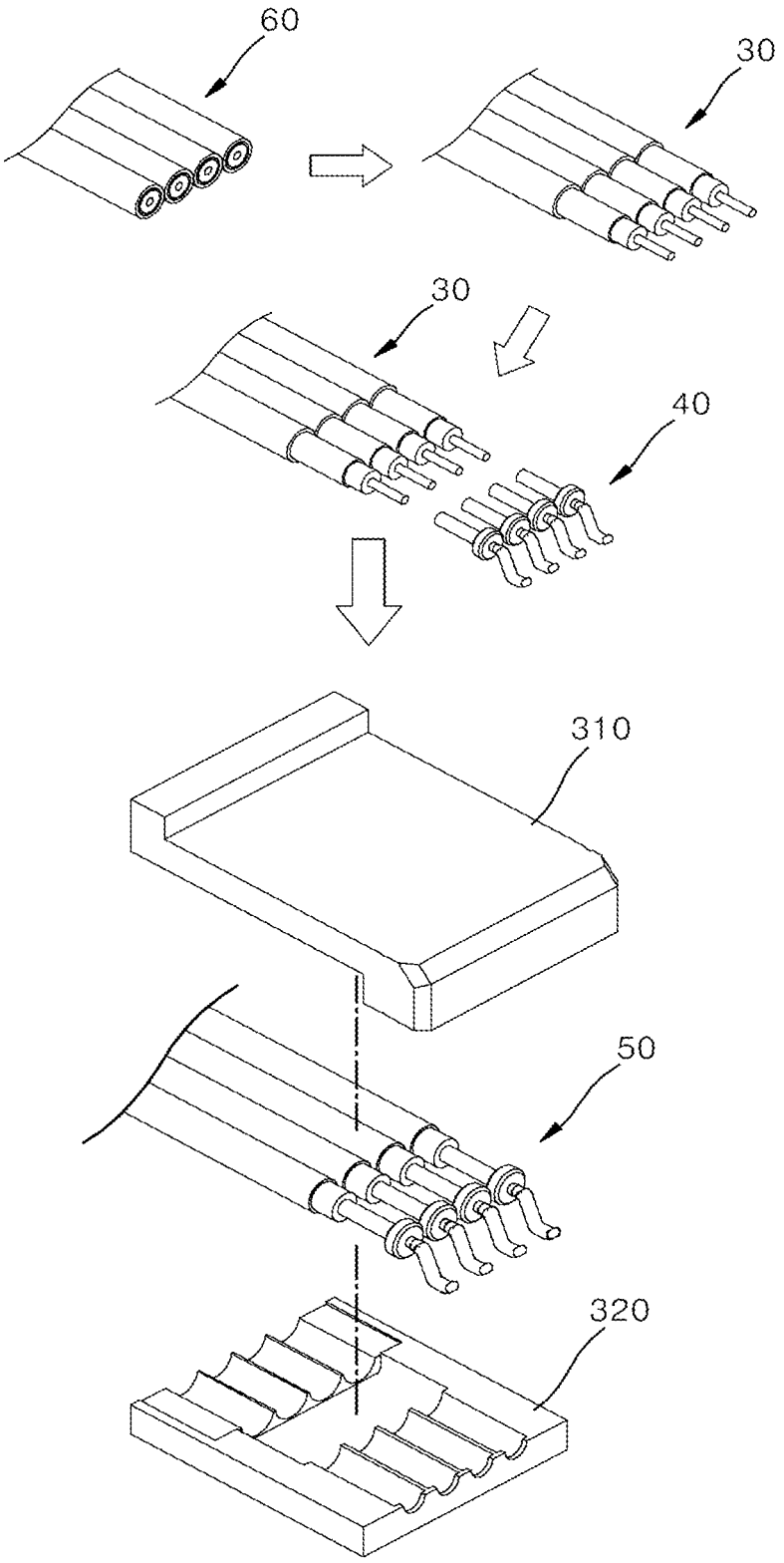
FIG. 11 is a view showing a process of assembling a coaxial cable male connector according to a second embodiment of the present invention, wherein a shielding can of the male connector is composed of two pieces.
Figure 12:
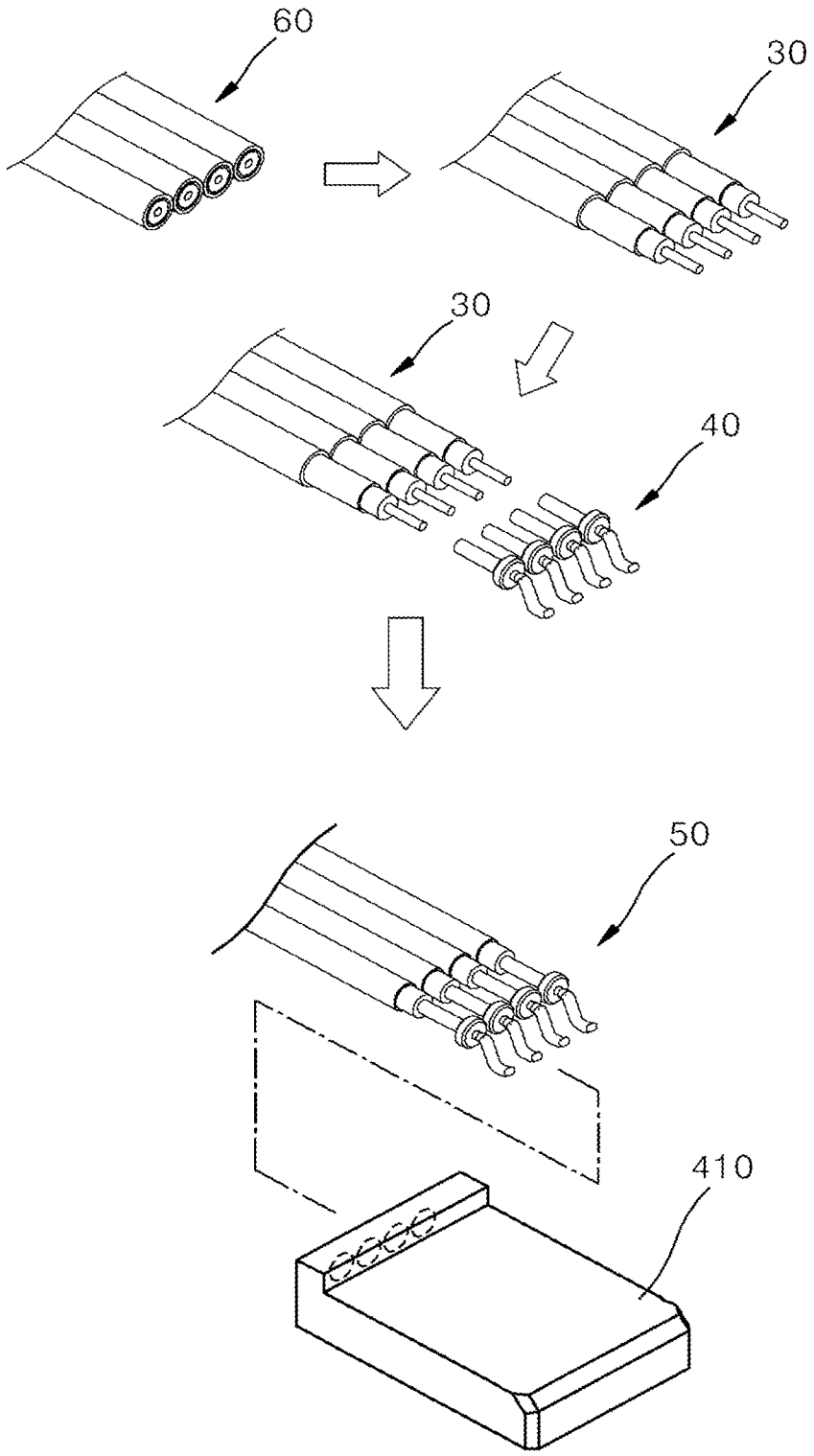
FIG. 12 is a view showing a process of assembling a coaxial cable male connector according to a third embodiment of the present invention, wherein a shielding can of the male connector is composed of one piece.

FIG. 7 is a view of exemplary components constituting the coaxial cable male connector 20 for transmitting super-high frequency signals according to the present invention. The coaxial cable male connector 20 for transmitting super-high frequency signals according to the present invention includes the coaxial cables 30 and the shielding can 270, 280, 290, and may further include an adapter unit 40. The sheath 240, the outer conductor 230, and the dielectric 220 of the coaxial cable 30 are partially stripped. The outer conductor 130 of each of the coaxial cables 30 may be connected to the shielding can 270, 280, 290. The shielding can 270, 280, 290 receives, protects, and secures the coaxial cables 30 and blocks electromagnetic waves generated from the inner conductors 210 of the coaxial cables. The shielding can 270, 280, 290 may be formed by coupling a lower shielding member 270, an upper shielding member 280, and a front shielding member 290 to one another. However, it will be understood that the present invention is not limited thereto and the shielding can may be composed of two pieces, such as a first shielding member 310 and a second shielding member 320, as shown in FIG. 11, or may be composed of one shielding member 410, upper, lower and front portions of which are integrally formed with one another, as shown in FIG. 12.

The adapter unit 40 includes a multiple adapters. Each of the adapters 42 is shaped to be easily shielded by the shielding can 270, 280, 290, 310, 320, 410 and to allow easy connection between the inner conductor 210 of the coaxial cables 30 and the circuit signal line terminal pads 214 formed on the PCB 215, and includes a conductor portion 250 and a dielectric portion 260. One end of the conductor portion 250 is brought into contact with and connected to the signal line terminal pad 214 on the PCB 215 and the other end of the conductor part 250 receives and is connected to the signal line 210, that is, the inner conductor of the coaxial cable 30. When the inner conductor, that is, the signal line of the cable, is inserted into and connected to the adapter 42, the one end of the conductor portion 250, which corresponds to the cable signal line terminal 255 of FIG. 4, is brought into contact with and connected to the signal line terminal pad 214 on the PCB 215. The dielectric portion 260 serves to separate the conductor portion 250 received in the shielding can 270, 280, 290, 310, 320, 410 from the shielding can.

The shielding can 270, 280, 290, 310, 320, 410 includes an inner conductor reception portion 272 or an adapter reception portion 272 formed therein and having cylindrical portions adapted to receive the adapters 42 one-to-one connected to the inner conductors 210 of the single or multiple coaxial cables, respectively. Upon omitting the adapters, the inner conductor reception portion 272 is provided to receive the exposed inner conductors. The inner conductor reception portion 272 is shaped to form shielding walls adapted to separate the exposed inner conductors received in the inner conductor reception portion from one another and to shield the exposed inner conductors upon coupling of the lower shielding member 270 to the upper shielding member 280 and the front shielding member 290. Upon providing the adapters, the adapter reception portion 272 is provided to receive the adapters 42 connected to the inner conductors. The adapter reception portion 272 is shaped to form shielding walls adapted to separate the adapters received in the adapter reception portion from one another and to shield the adapters upon coupling of the lower shielding member 270 to the upper shielding member 280 and the front shielding member 290.

Figure 8:
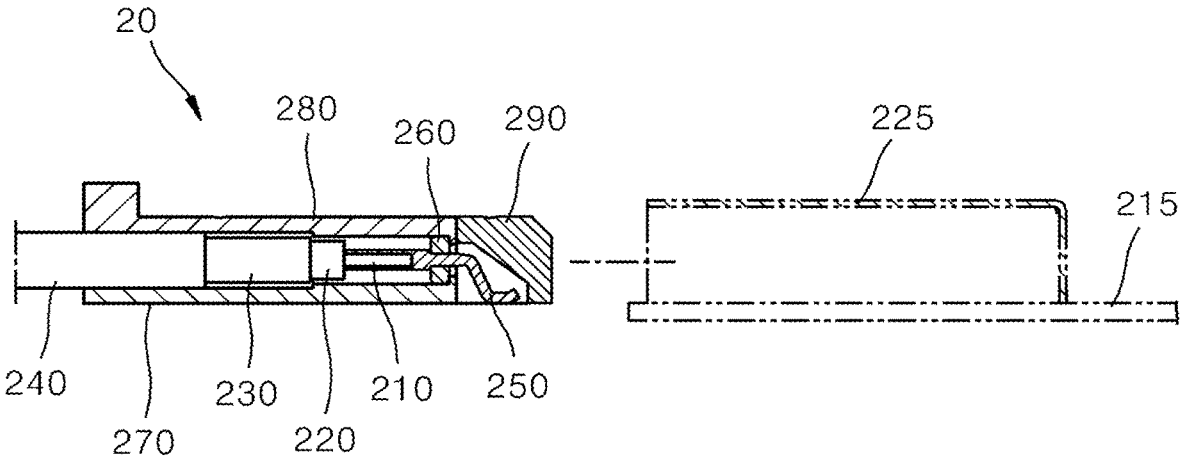
FIG. 8 is a sectional view of the coaxial cable male connector for transmitting super-high frequency signals according to the present invention shown in FIG. 2, taken along line VII-VII.
Figure 9:
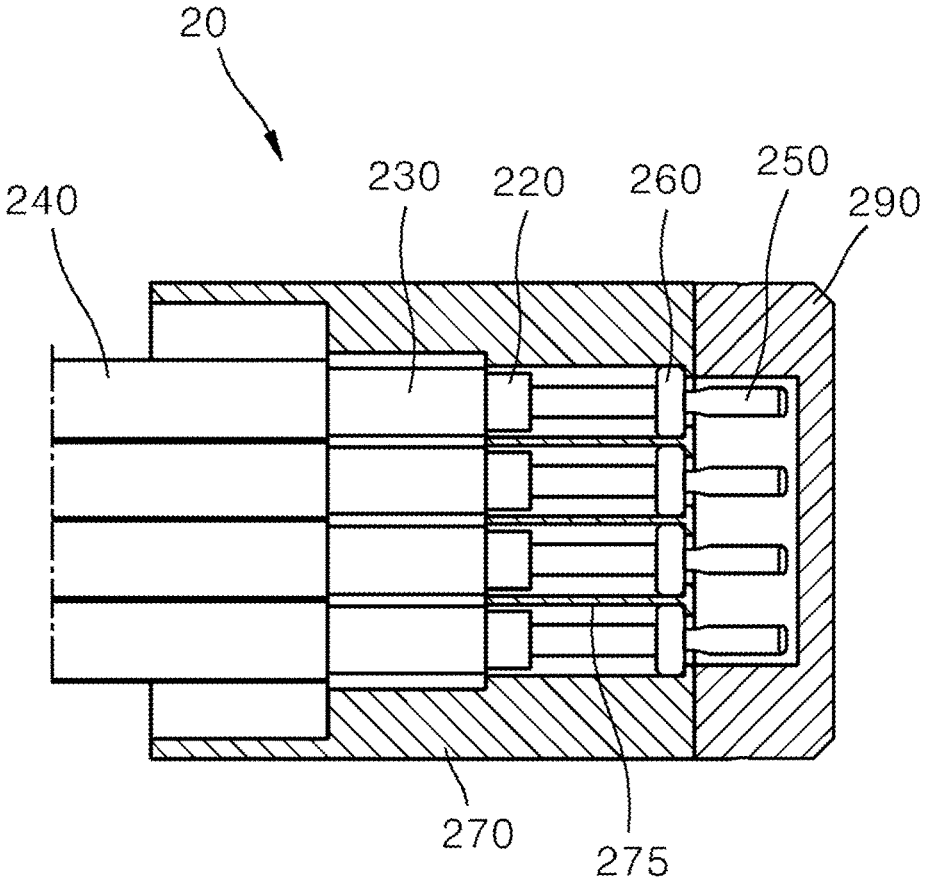
FIG. 9 is a sectional view of the coaxial cable male connector for transmitting super-high frequency signals according to the present invention shown in FIG. 2, taken along line VIII-VIII.

FIG. 8 is a sectional view of the coaxial cable male connector 20 for transmitting super-high frequency signals according to the present invention shown in FIG. 2, taken along line VII-VII, and FIG. 9 is a sectional view of the coaxial cable male connector 20 for transmitting super-high frequency signals according to the present invention shown in FIG. 2, taken along line VIII-VIII. Referring to FIG. 8 and FIG. 9, with the coaxial cables 210, 220, 230, 240 and the adapters 250, 260 received, protected, and shielded by the shielding can 270, 280, 290, the coaxial cable male connector 20 is inserted into and fastened to the connector socket 225 mounted on the PCB 215. In particular, FIG. 9 shows the shielding walls 275 formed by coupling the lower shielding member 270, the upper shielding member 280, and the front shielding member 290 to one another, wherein the shielding walls separate the adapters from one another while shielding the adapters.

Figure 10:
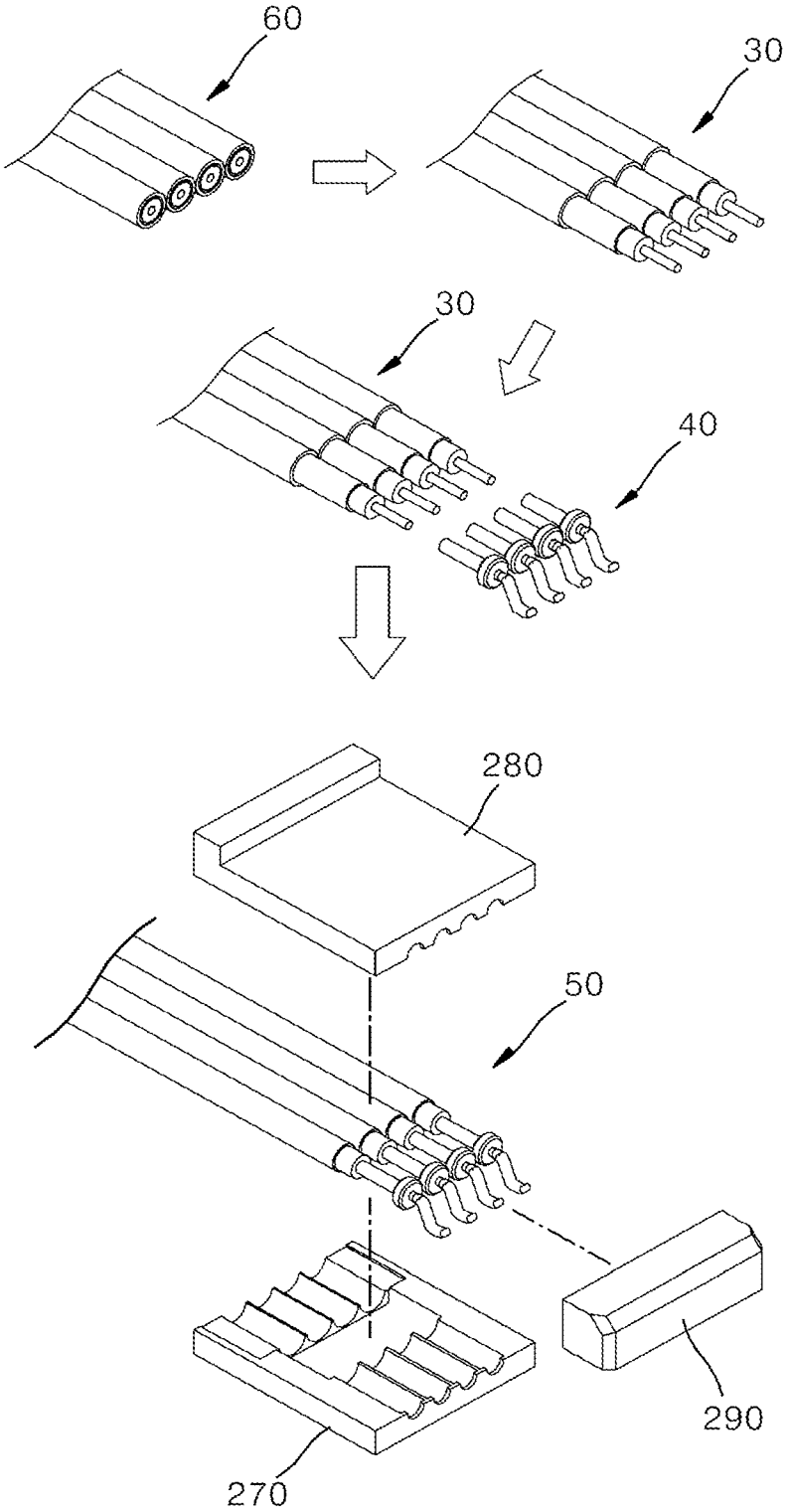
FIG. 10 is a view showing a process of assembling a coaxial cable male connector according to a first embodiment of the present invention, wherein a shielding can of the male connector is composed of three pieces.

FIG. 10 is a view showing a process of assembling a coaxial cable male connector according to a first embodiment of the present invention, wherein a shielding can of the male connector is composed of three pieces. Referring to FIG. 10, unstripped coaxial cables 60 are stripped, followed by connecting the stripped coaxial cables 30 to the adapter unit 40, and then the coaxial cables 50 connected to the adapter unit 40 are seated on the lower shielding member 270, which, in turn, is coupled to the upper shielding member 280 and the front shielding member 290.

The lower shielding member 270 forms a lower portion of the shielding can and receives the exposed inner conductors of the coaxial cables such that ends 255 of the exposed inner conductors are located thereon. The upper shielding member 280 covers the exposed inner conductors of the coaxial cables received in the lower shielding member 270. The front shielding member 290 corresponds to a front portion of the shielding can and is coupled to the lower shielding member 270 and the upper shielding member 280 to shield the exposed inner conductors of the coaxial cables.

FIG. 11 is a view showing a process of assembling a coaxial cable male connector according to a second embodiment of the present invention, wherein a shielding can of the male connector is composed of two pieces. Referring to FIG. 11, unstripped coaxial cables 60 are stripped, followed by connecting the stripped coaxial cables 30 to the adapter unit 40, and then the coaxial cables 50 connected to the adapter unit 40 are seated on a first shielding member 310, which, in turn, is coupled to a second shielding member 255. The first shielding member 310 forms a lower portion of the shielding can and receives the exposed inner conductors of the coaxial cables such that ends 255 of the exposed inner conductors are located thereon.

FIG. 12 is a view showing a process of assembling a coaxial cable male connector according to a third embodiment of the present invention, wherein a shielding can of the male connector is composed of one piece. Referring to FIG. 12, unstripped coaxial cables 60 are stripped, followed by connecting the stripped coaxial cables 30 to the adapter unit 40, and then the coaxial cables 50 connected to the adapter unit 40 are seated on a shielding member 410 having upper, lower, and front portions integrally formed with one another. The shielding member 410 shields the exposed inner conductors of the coaxial cables and has a bottom surface on which ends of the exposed inner conductors of the coaxial cables or terminals 255 of the adapters connected to the inner conductors are located.

The coaxial cable male connector for transmitting super-high frequency signals according to the present invention can provide maximized shielding against electromagnetic waves generated from the exposed inner conductors of the coaxial cables used as signal lines. Specifically, the exposed inner conductors of the multiple coaxial cables connected to the coaxial cable male connector according to the present invention are separated from one another and are individually shielded by the shielding walls of the inner conductor receiving portion or the adapter receiving portion inside the shielding can, and the shielding can 270, 280, 290, 310, 320, 410 of the coaxial cable male connector 20 according to the present invention is connected to the outer conductors 230 of the coaxial cable 30. The connector socket 215 formed of a conductor is connected to a ground terminal of the PCB 215. When the coaxial cable male connector 20 is inserted into and fastened to the connector socket 225 mounted on the PCB 215, the shielding can 270, 280, 290, 310, 320, 410 of the coaxial cable male connector 20 connected to the outer conductors 230 of the coaxial cables 30 is brought into contact with and connected to the connector socket 225 connected to the ground terminal of the PCB 215, thereby providing maximized shielding against electromagnetic waves generated from the signal line terminals in the coaxial cable male connector, which directly contact the circuit signal line terminal pads 214 on the PCB 215, respectively.

Although some embodiments have been described herein with reference to the accompanying drawings, it should be understood by those skilled in the art that these embodiments are given by way of illustration only and the present invention is not limited thereto and that various modifications, variations, and alterations can be made by those skilled in the art without departing from the spirit and scope of the present invention. Therefore, the scope of the invention should be limited only by the accompanying claims and equivalents thereto.

<List of Reference numerals>

| | |
|---|---|
| 110: Male connector | 112: Male connector housing |
| 114: Electrical signal line | 150: Female connector |
| 152: Female connector housing | 154: Terminal (pin) reception member |
| 20: Coaxial cable male connector | 210: Inner conductor (signal line) |
| 214: PCB terminal pad | 215: Printed circuit board (PCB) |
| 220: Dielectric | 222: Fastening portion |
| 225: Connector socket | 230: Outer conductor (shielding layer) |
| 240: Sheath (jacket) | 250: Adapter conductor portion |
| 260: Adapter dielectric portion | 270: Lower shielding member |
| 272: Adapter reception portion | 280: Upper shielding member |
| 290: Front shielding member | 30: Coaxial cable |
| 40: Adapter unit | 42: Adapter |
| 410: Shielding member | 50: Coaxial cable connected to adapter |
| 60: Unstripped coaxial cable | |

What is claimed is:

1. A coaxial cable connector for transmitting super-high frequency signals, which is received in a connector socket mounted on a printed circuit board (PCB) to connect a single or multiple coaxial cables to the PCB, the coaxial cable connector comprising:

a single or multiple coaxial cables each comprising an inner conductor, an outer conductor, a dielectric, and a sheath, wherein the outer conductor, the dielectric, and the sheath are partially stripped to expose the inner conductor over a predetermined length, and a terminal of the exposed inner conductor is brought into electrical contact with a signal line terminal pad formed on the PCB; and a shielding can receiving the exposed inner conductors of the single or multiple coaxial cables, securing and protecting ends of the exposed inner conductors, and blocking electromagnetic waves generated from the inner conductors, wherein the terminals of the inner conductors of the coaxial cables are formed on a bottom surface of the shielding can to be brought into contact with the signal line terminal pads formed on the PCB, respectively, wherein the shielding can comprises: a lower shielding member forming a lower portion of the shielding can and receiving the exposed inner conductors of the coaxial cables such that the ends of the exposed inner conductors are located thereon; an upper shielding member covering the exposed inner conductors of the coaxial cables received in the lower shielding member; and a front shielding member forming a front portion of the shielding can and coupled to the lower shielding member and the upper shielding member to shield the exposed inner conductors of the coaxial cables, wherein the coaxial cable connector further comprises: adapters each connected at one end thereof to a corresponding one of the exposed inner conductors of the coaxial cables and connected at the other end thereof to a corresponding one of the signal line terminal pads formed on the PCB to allow easy contact between the terminals of the inner conductors of the coaxial cables and the circuit signal line terminal pads formed on the PCB, and the terminals of the inner conductors of the coaxial cables are connected to the signal line terminal pads formed on the PCB via the adapters, respectively, wherein each adapter comprises a conductor portion, and a dielectric portion which serves to separate the conductor portion from the shielding can, wherein the shielding can comprises an adapter reception portion receiving the adapters one-to-one connected to the exposed inner conductors of the coaxial cables, the adapter reception portion being shaped to individually shield the adapters, and wherein the shielding can is connected to the outer conductors of the coaxial cables; and the connector socket receives the shielding can and is electrically connected to the shielding can and a ground terminal of the PCB to electrically shield the exposed inner conductors of the coaxial cables and the adapters.

2. The coaxial cable connector according to claim 1, wherein the shielding can is configured such that the upper shielding member and the front shielding member are integrally formed.

3. The coaxial cable connector according to claim 1, wherein the shielding can is configured such that the upper, lower, and front shielding members are integrally formed with one another.

* * * * *